US008403149B2

(12) United States Patent
Kadota et al.

(10) Patent No.: US 8,403,149 B2
(45) Date of Patent: Mar. 26, 2013

(54) CYCLONE CLASSIFIER, FLASH DRYING SYSTEM USING THE CYCLONE CLASSIFIER, AND TONER PREPARED BY THE FLASH DRYING SYSTEM

(75) Inventors: Takahiro Kadota, Numazu (JP); Kenichi Uehara, Susono (JP); Noboru Kuroda, Izunokuni (JP); Masato Kobayashi, Suntou-gun (JP)

(73) Assignee: Ricoh Company, Ltd., Tokyo (JP)

( * ) Notice: Subject to any disclaimer, the term of this patent is extended or adjusted under 35 U.S.C. 154(b) by 739 days.

(21) Appl. No.: 11/561,220

(22) Filed: Nov. 17, 2006

(65) Prior Publication Data

US 2007/0114159 A1 May 24, 2007

(30) Foreign Application Priority Data

Nov. 18, 2005 (JP) ..... 2005-334254
Mar. 15, 2006 (JP) ..... 2006-070287
Aug. 1, 2006 (JP) ..... 2006-209635
Aug. 23, 2006 (JP) ..... 2006-226266

(51) Int. Cl.
*B04C 5/24* (2006.01)

(52) U.S. Cl. ..... 209/711; 209/139.1; 209/715

(58) Field of Classification Search ..... 209/12.1, 209/725, 727, 728, 139.1, 711–721
See application file for complete search history.

(56) References Cited

U.S. PATENT DOCUMENTS 2,153,026 A * 4/1939 Ringius ..... 55/459.1
3,960,734 A * 6/1976 Zagorski ..... 210/512.2
4,304,360 A 12/1981 Luhr et al.
5,762,666 A * 6/1998 Amrein et al. ..... 55/425
5,938,045 A * 8/1999 Makino et al. ..... 209/713
5,958,094 A * 9/1999 Schwamborn et al. ..... 55/331
6,074,795 A 6/2000 Watanabe et al.
6,180,298 B1 1/2001 Kuroda et al.
6,183,926 B1 2/2001 Kuroda et al.
6,258,502 B1 7/2001 Nakamura et al.
6,395,443 B2 5/2002 Kuroda et al.
6,432,590 B1 8/2002 Ueda et al.
6,568,536 B2 * 5/2003 Tanaka et al. ..... 209/139.2
7,011,921 B2 3/2006 Koeda et al.
7,347,332 B2 * 3/2008 Hakola ..... 209/715
2001/0005986 A1 7/2001 Matsubara et al.

(Continued)

FOREIGN PATENT DOCUMENTS

JP 29-16797 12/1954
JP 36-12179 5/1961

(Continued)

OTHER PUBLICATIONS

Office Action issued Feb. 2, 2011, in Japan Patent Application No. 2006-226266.

(Continued)

*Primary Examiner* — Joseph C Rodriguez
*Assistant Examiner* — Kalyanavenkateshware Kumar
(74) *Attorney, Agent, or Firm* — Oblon, Spivak, McClelland, Maier & Neustadt, L.L.P.

(57) ABSTRACT

A cyclone classifier for classifying a particulate material, including an outer cylinder having a waistless part and an inverted-cone part vertically connected to an underside of the waistless part, and an inner cylinder which includes an exhaust opening such that the inner cylinder has a position-adjustable bottom end.

19 Claims, 6 Drawing Sheets

U.S. PATENT DOCUMENTS

| | | | | |
|---|---|---|---|---|
| 2004/0234882 | A1 | 11/2004 | Matsui et al. | |
| 2005/0242008 | A1 * | 11/2005 | Simpson | 209/717 |
| 2006/0032952 | A1 | 2/2006 | Kawamoto et al. | |
| 2006/0039234 | A1 | 2/2006 | Koeda et al. | |

FOREIGN PATENT DOCUMENTS

| | | | | |
|---|---|---|---|---|
| JP | 54-4818 | | | 1/1979 |
| JP | 60-9997 | U | | 1/1985 |
| JP | 60-34756 | | | 2/1985 |
| JP | 63-136747 | U | | 9/1988 |
| JP | 2-191555 | | | 7/1990 |
| JP | 03-079906 | | | 4/1991 |
| JP | 05007842 | A | * | 1/1993 |
| JP | 5-161861 | | | 6/1993 |
| JP | 6-91974 | | | 11/1994 |
| JP | 08-266938 | | | 10/1996 |
| JP | 8-266938 | | | 10/1996 |
| JP | 2742669 | | | 2/1998 |
| JP | 10-230223 | | | 9/1998 |
| JP | 10-314623 | | | 12/1998 |
| JP | 2000-107698 | | | 4/2000 |
| JP | 2003-275685 | | | 9/2003 |
| JP | 2004-283720 | | | 10/2004 |
| JP | 4024566 | | | 10/2007 |

OTHER PUBLICATIONS

Office Action issued Feb. 2, 2011, in Japan Patent Application No. 2006-209635.

Office Action issued Aug. 27, 2010, in Chinese Patent Application No. 200610149445.1.

* cited by examiner

CYCLONE CLASSIFIER, FLASH DRYING SYSTEM USING THE CYCLONE CLASSIFIER, AND TONER PREPARED BY THE FLASH DRYING SYSTEM

BACKGROUND OF THE INVENTION

1. Field of the Invention

The present invention relates to a cyclone apparatus for classifying and collecting a powder, and more particularly to a cyclone classifier and a flash drying system for drying and preparing a toner.

2. Discussion of the Background

Recently, powder is required to have sophisticated features such as a small particle diameter and a sharp particle diameter distribution. A powder having a broad particle diameter distribution has various uneven performances. The powder preferably has a uniform particle diameter to have high performances. A toner having a broad particle diameter distribution for use in electrophotography is also disadvantageous for its required uses such as being uniformly charged and melted.

Many classifying methods are known for making the particle diameter uniform. The classifying methods include a method of using a cyclone collector. Typically, the cyclone collector is used as a solid-gas separating apparatus. A powder transferred into a cyclone classifier using an airflow centrifugally accumulates on the wall of an outer cylinder with a swirling flow and gradually drops in a container installed at an under part of the outer cylinder of the cyclone classifier. The gas, which is much lighter than the particle (mostly air), is discharged out of the cyclone classifier from an inner cylinder in the center thereof.

A classifier using the cyclone collector for separating a solid from a gas, which discharges a powder having a small particle diameter together with the gas is also known. The cyclone collector is used for separating a solid from a gas and transporting a powder. A cyclone collector having an additional classifying function has an advantage of reducing capacity investment and man-hours.

The cyclone collector handles a powder having a particle diameter not greater than 1 mm.

Japanese Laid-Open Patent Publication No. 10-230223 discloses a classifying method of using a filter effect by placing a cylinder having pores between an outer cylinder and an inner cylinder of a cyclone collector. Japanese Laid-Open Patent Publication No. 8-2666938 discloses a method of controlling a classifying particle diameter by changing a gap due to pitch, wherein a slide plate changing the opening width of an entrance of a cyclone collector is arranged and the tip of a circular cone and is located facing the lower end of an outer cylinder of the cyclone collector. Further, Japanese Laid-Open Patent Publication No. 2004-283720 discloses a method of collecting an air stream including a powder in the center of the inner cylinder by increasing a flow speed with a division plate having an orifice having an area smaller than that of an end-opening of an inner cylinder, which is concentrically located in the center of an outer cylinder.

Controlling the classifying particle diameter is one of the important functions of a cyclone classifier, and a more important thing is how a powder is distributed in the order of particle diameter from smaller to larger toward the circumferential surface of anouter cylinder with a centrifugal force.

A powder having a larger particle diameter receives a stronger centrifugal force. Therefore, it is ideal that the powder having a smaller particle diameter is distributed in the center of the outer cylinder, i.e., around the inner cylinder of the cyclone classifier, and the powder having a larger particle diameter is distributed around the circumferential surface of the outer cylinder in the order of particle diameter almost continuously. When the classification point is controlled, a good-yield classifier and a classifying process separating powder having a sharp particle diameter distribution can be provided. In other words, it is necessary that a powder is specifically distributed in the order of particle diameter from the center to the circumferential surface of the outer cylinder, otherwise the powder cannot be classified even when the classification point is controlled.

In the method disclosed in Japanese Laid-Open Patent Publication No. 8-2666938, the opening width can be narrowed. However, when toner having different particle diameters is being mixed and gathered and already receiving centrifugal forces, the toner cannot be classified.

Even when a powder having a wide particle diameter distribution receives a centrifugal force on a swirling flow in the cyclone classifier when flown into the outer cylinder of a cyclone classifier, the powder cannot be classified to have desired particle diameters. This is because particles having various particle diameters, which come from the entrance varying in size, are nonuniformly mixed at a radial position where they begin to receive centrifugal forces. When a centrifugal force is further applied to the particles (the particles stay longer in the outer cylinder of the cyclone classifier), almost all the particles thinly gather on the inner wall of the outer cylinder and cannot be classified.

Because of these reasons, a need exists for a cyclone classifier capable of separating a powder having a sharp particle diameter distribution at a high yield.

SUMMARY OF THE INVENTION

Accordingly, an object of the present invention is to provide a cyclone classifier capable of separating a powder having a sharp particle diameter distribution at a high yield.

Another object of the present invention is to provide a flash drying system including the cyclone classifier.

A further object of the present invention is to provide a toner prepared by the flash drying system.

These objects and other objects of the present invention, either individually or collectively, have been satisfied by the discovery of a cyclone classifier for classifying a particulate material, including an outer cylinder including a waistless part, and an inverted-cone part vertically connected to an underside of the waistless part, and an inner cylinder comprising an exhaust opening, wherein the inner cylinder has a position-adjustable bottom end.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
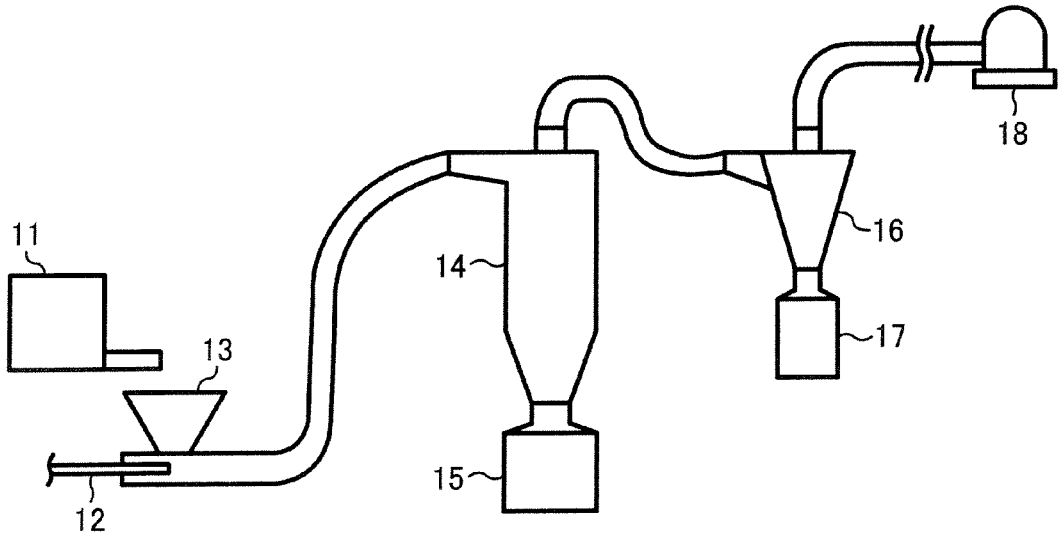
FIG. 1 is a schematic view illustrating the flash drying system using an embodiment of the cyclone classifier of the present invention.

The present invention provides a cyclone classifier capable of separating a powder having a sharp particle diameter distribution at a high yield.

For example, when a polymerized toner is classified, a flash drier is used in the process of drying a wet colored and polymerized particulate material, and the cyclone collector of one embodiment of the present invention is used to separate a solid from a gas. Therefore, in an exemplary embodiment of the present invention, both the drying process and the classifying process can be performed at the same time. Alternatively, the classifying process can be performed after the drying process.

Keen studies by the present inventors of conditions of preparing a colored and polymerized particulate material having a desired sharp particle diameter distribution at a high yield, using a cyclone classifier in the process of classifying the colored and polymerized particulate material led to the present invention. After toner constituents including at least a resin and a colorant are dissolved or dispersed in an organic solvent to prepare a solution or a dispersion, the solution or the dispersion is emulsified and washed in an aqueous medium to prepare a wet cake, and the wet cake is dried with a flash drier.

Hereinafter, a first embodiment of the cyclone classifier of the present invention will be explained in detail.

A toner is exemplified in the explanations, but powder to be classified by the cyclone classifier of the present invention is not limited a polymerized toner and a pulverized toner, and any powder can be classified thereby.

As shown in FIGS. 2 to 6, the cyclone classifiers of exemplary embodiments of the present invention include outer cylinders 22 (22A and 22B), 32 (32A and 32B), 42 (42A and 42B) and 52 (52A and 52B) and inner cylinders 24, 34A, 34B, 44 and 54. The outer cylinders have under parts with diameters expanding upward and upper parts. Each of the upper parts comprises an enlarged portion having almost the same diameter as the maximum diameter of each of the under parts. Each of the bottom ends of the inner cylinders 24, 34A, 34B, 44 and 54 is present in the enlarged portion. In the cyclone classifier, particles receive centrifugal forces in the radial direction of the swirling flow. The centrifugal force becomes larger in proportion to the particle diameter, and particles having small particle diameters gather around the center of the swirl and particles having large particle diameters gather around the outer circumference of the swirl.

In an exemplary embodiment of the present invention, each of the outer cylinders 22, 32, 42 and 52 includes an enlarged portion 22B, 32B, 42B, and 52B. The swirl flow falls down to the bottom of the outer cylinder 22, 32, 42 and 52, swirling in the direction of an arrow from each of inlets 21, 31, 41 and 51, and is introduced into an end of each of inner cylinders 24, 34A, 34B, 44 and 54 to be discharged. A powder coming from each of the inlets 21, 31, 41 and 51 receives a centrifugal force in each of the non-enlarged portions 22A, 32A, 42A, and 52A, and almost all the particles are pressed to the circumferential surface of the non-enlarged portion 22A, 32A, 42A, and 52A. Then, the particles gather and enter the following enlarged portion 22B, 32B, 42B, and 52B in the shape of a thin film. Right after the various particles enter the enlarged portion 22B, 32B, 42B, and 52B, they leave from the circumferential surface of the non-enlarged portion 22A, 32A, 42A, and 52A and each of them is radially dispersed in accordance with its diameter by a centrifugal force applied thereto.

The centrifugal force F applied to each particle can be decided by the following formula:

$$F=mV^2/R$$

wherein m represents a mass of a particle; V represents a swirling speed; and R represents a swirling radius.

The particle diameter is proportional to the mass of each particle, and the centrifugal force is applied thereto in proportion to the particle diameter and a particle diameter distribution is radially made. The particles having small particle diameters stay in the center of the enlarged portion 22B, 32B, 42B, and 52B and the particles having large particle diameters are radially distributed almost in the order of particle diameter from smallest to largest.

When the particles distributed in the order of particle diameter are aspirated from the bottom end of inner cylinder 24, 34A, 34B, 44 and 54 at a position, particles having a desired particle diameter (distribution) are very efficiently separable.

One of means of changing the classification point includes a vertically-movable inner cylinder 24, 34A, 34B, 44 and 54. However, the bottom end of the inner cylinder 24, 34A, 34B, 44 and 54 may be present within the enlarged portion 22B, 32B, 42B, and 52B.

In addition, a contracted part having a small diameter can be inserted to a connection point between the non-enlarged portion 22A, 32A, 42A, and 52A and the enlarged portion 22B, 32B, 42B, and 52B to apply larger centrifugal force to a powder toner. All particles gather in the shape of a thin film in the contracted part and widely disperse right away just when they enter the enlarged portion 22B, 32B, 42B, and 52B, and therefore they are more efficiently classified.

Further, in order to more efficiently classify particles, a baffle plate 23, 33A, 43, and 53 (also called an orifice plate) having an orifice larger than the inner cylinder diameter can be inserted in the center of the outer cylinder 22, 32, 42 and 52. The bottom end of the inner cylinder 24, 34A, 34B, 44 and 54 can be placed at the head of the baffle plate 23, 33A, 43, and 53. However, in an exemplary embodiment of the present invention, particles are effectively dispersed in the enlarged portion 22B, 32B, 42B, and 52B under the baffle plate 23, 33A, 43, and 53, and the bottom end of the inner cylinder 24, 34A, 34B, 44 and 54 may be placed at the bottom of the baffle plate 23, 33A, 43, and 53.

In the cyclone classifier of an exemplary embodiment of the present invention, one of the following relationships may be satisfied for the order of cylinder diameter:

$$De>1.2\times Ds$$

$$De>1.2\times Dr$$

wherein De represents a diameter of the enlarged portion 22B, 32B, 42B, and 52B; Ds represents a diameter of the non-enlarged portion 22A, 32A, 42A, and 52A; and Dr represents a diameter of the contracted part 5.

When the bottom end of the inner cylinder 24, 34A, 34B, 44 and 54 is located too far from the entrance of the enlarged portion 22B, 32B, 42B, and 52B, it is probable that the inner cylinder 24, 34A, 34B, 44 and 54 aspirates particles having undesired (large) particle diameters. Therefore, the bottom end of the inner cylinder 24, 34A, 34B, 44 and 54 is preferably located in the vertical at a position having the following distance from the connecting point between the enlarged portion 22B, 32B, 42B, and 52B and the non-enlarged portion 22A, 32A, 42A, and 52A or the contracted part 5:

$$10\times((De-Ds)/2) \text{ or } 10\times((De-Dr)/2).$$

Figure 2:
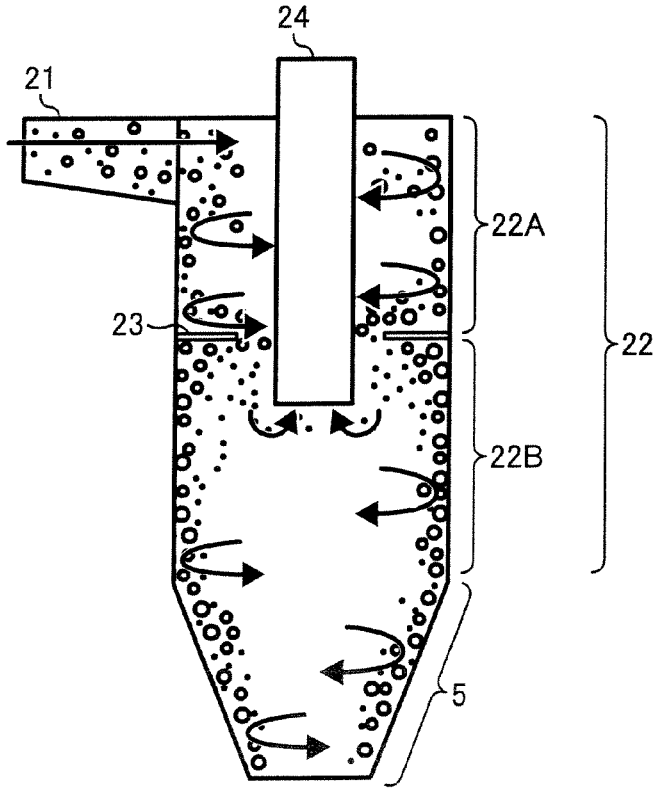
FIG. 2 is a schematic view illustrating an embodiment of the cyclone classifier of the present invention.
Figure 3:
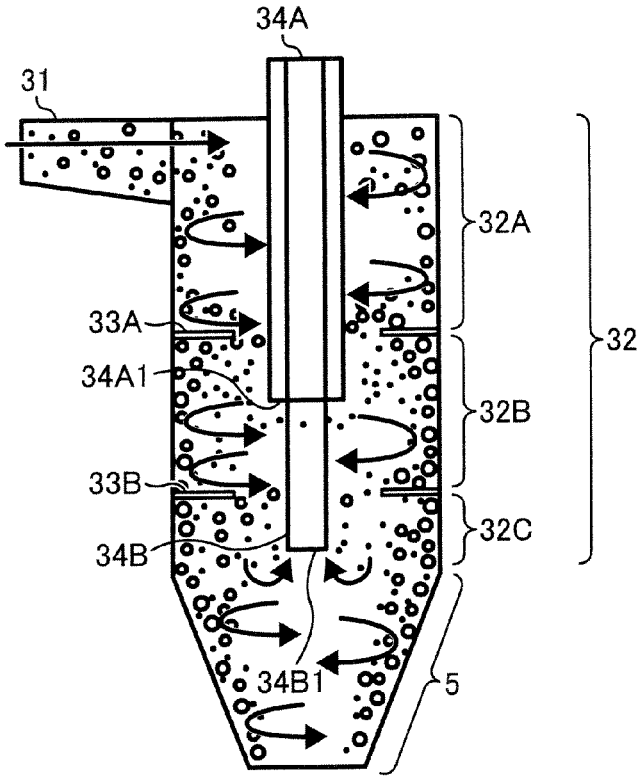
FIG. 3 is a schematic view illustrating another embodiment of the cyclone classifier of the present invention.

The inner cylinder may be a mono cylinder (as in FIGS. 2 and 4-6), and is preferably a multiple cylinder for more precisely classifying particles (as in FIG. 3). The bottom end of the inner cylinder 24, 34A, 34B, 44 and 54 is preferably present within the enlarged portion 22B, 32B, 42B, and 52B. When each of the multiple cylinders has a different length from each other, a small amount of particles can be discharged for several times and the particles can more precisely be classified. When the bottom end of each of the multiple cylinders is changeable, the classification point can precisely be controlled.

A cyclone classifier having plural enlarged portions, as shown in FIG. 3, can more precisely classify particles. When a cyclone classifier has a double (a first and a second) enlarged portion 32B, 32C and a double inner cylinder 34A, 34B, it is preferable that the bottom end 34A1 of one of the inner cylinders 34A is present within the first enlarged portion 32B and that the bottom end 34B1 of the other inner cylinder 34B is present within the second enlarged portion 32C. Plural baffle plates each having an orifice can replace the plural enlarged portions.

Combinations of plural enlarged portions, plural baffle plates and multiple inner cylinders can decide a desired particle diameter and distribution thereof to more precisely classify particles.

Particles each having a large particle diameter fly out to the inner wall near the entrance of the enlarged portion. When a collection pocket is formed on the wall, only the particles each having a large particle diameter can be classified. When the position of the flow entrance to the collection pocket is controlled with a slide moving up and down, the classification point of the particles each having a large particle diameter can be controlled.

Further, when the bottom end of the inner cylinder has a control plate (not shown) controlling the flow area, the inflow speed of air stream into the inner cylinder can be controlled and stabilized.

The control plate may be a flat plate, and preferably has the shape of a cone because the air stream is aspirated into the inner cylinder without turbulence. The air stream inflow area is formed of a gap between the bottom end of the inner cylinder and the control plate.

Figure 6A:
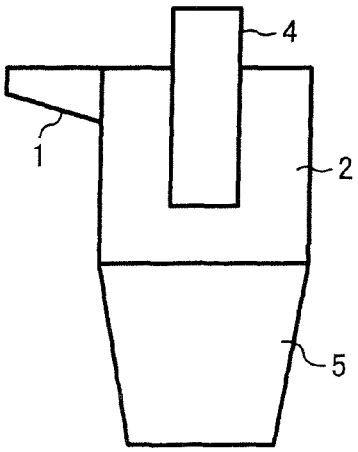
FIG. 6A is a schematic view illustrating a standard embodiment of the cyclone classifier of the present invention.
Figure 6B:
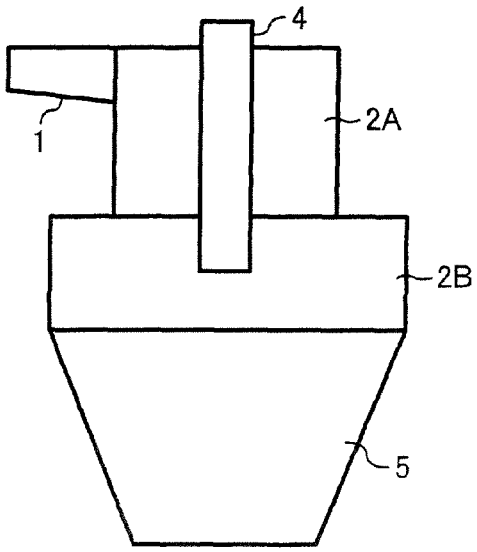
FIG. 6B is a schematic view illustrating a partially enlarged embodiment of the cyclone classifier of the present invention.

FIG. 6A is a schematic view illustrating an exemplary embodiment of the cyclone classifier of the present invention, and FIG. 6B is a schematic view illustrating a partially enlarged embodiment of the cyclone classifier of the present invention.

FIG. 6A includes an inlet 1, an outer cylinder 2, an inner cylinder 4, and a bottom 5.

FIGS. 2 to 5 are exemplary embodiments of the cyclone classifier, and may be partially enlarged as shown in FIG. 6B. The partially enlarged cyclone classifier includes an inlet 1, a non-enlarged portion 2A, an enlarged portion 2B, a bottom 5 and an inner cylinder 4. The non-enlarged portion 2A and the enlarged portion 2B in the exemplary embodiments of the cyclone classifier have the same diameter. An orifice forms a contracted part and the enlarged portion of the outer cylinder is from the orifice to the border with the bottom. The non-enlarged portion 2A and the enlarged portion 2B form the outer cylinder.

In the partially enlarged cyclone classifier, an orifice may or may not be included in the enlarged portion, and the non-enlarged portion 2A and the enlarged portion 2B may be connected to each other through an orifice.

Next, the flash drying system using any one of the cyclone classifiers in FIGS. 2, 3, 4, 5, 6A and 6B will be explained, referring to FIG. 1.

An exemplary flash drying system includes a feeder feeding a powder (such as a toner) upstream of a cyclone classifier 14, and a cyclone collector 16 and an exhaust fan downstream thereof.

The feeder includes a powder feeding means (such as powder feeding air 12) and a powder feeder 11, and may include a saucer 13.

A feedback means may be formed between the cyclone collector 16 and the cyclone classifier 14 to feedback a part of a classified powder to the inlet of the cyclone classifier 14.

The feedback means preferably includes an aspirating mechanism and an exhaust mechanism, such as combination of a valve and an exhaust fan 18. Alternatively, the feedback means may only include an exhaust fan 18.

Further, in an exemplary flash drying system, the cyclone classifier 14 can be a multistage classifier when the cyclone collector 16 is replaced with a feedback means. Such a classifier can easily prepare classified toners having desired particle diameters.

The cyclone classifier 14 exerts its energy-saving effect when combined with apparatuses for use in other processes. When a wet colored and polymerized particulate material is dried by a flash drier in a drying process of a polymerized toner, the colored and polymerized particulate material discharged with air flow after being dried can be separated by the cyclone classifier 14 into a solid and a gas. At that time, when the colored and polymerized particulate material is classified as well, the cost of the whole equipment can be reduced and the number of man hours can largely be reduced. This largely improves the global environment as well.

Figure 8:
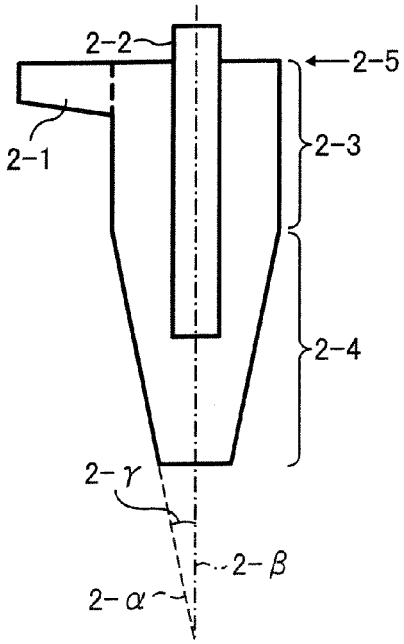
FIG. 8 is a schematic view illustrating a further embodiment of the cyclone classifier of the present invention.

Next, a second embodiment of the cyclone classifier of the present invention, as shown in FIG. 8, will be explained in detail.

A toner is exemplified in the explanations, but powders to be classified by the cyclone classifier of the present invention are not limited a polymerized toner and a pulverized toner, and any powder can be classified thereby.

The embodiment shown in FIG. 8 includes a cyclone classifier having an outer cylinder comprising an inverted-cone part (2-4) and a waistless part (2-3) thereon; and an inner cylinder (2-2), the one end of which is inserted into the outer cylinder. The end of the inner cylinder, which is an exhaust and aspirating opening inserted into the outer cylinder, is present within the height of the inverted-cone part (2-4). An inclined angle (2-γ) of a bus bar (2-α) of the inverted-cone part (2-4) to a normal (2-β) of a base of the inverted-cone part is important. When the inclined angle (2-γ) is large, a gap between the end of the inner cylinder and the inner surface of the cone largely varies even if the inner cylinder slightly moves up or down. In addition, the swirling diameter of the swirling flow largely varies, resulting in difficulty in fine tuning of the classifying particle diameter. Therefore, the inclined angle is preferably not greater than 45°.

An alternate embodiment of the present invention will now be described with respect to FIG. 9. The multiple inner cylinders 2-2*a*, 2-2*b* independently variable, e.g., a double cylinder, is capable of classifying a powder into three grades which are collected in a collection container (not shown) below the inverted-cone part (2-4), aspirated into an outer tube (not shown), and aspirated into an inner tube (not shown). The classifying particle diameters can be controlled as desired because the multiple inner cylinders 2-2*a*, 2-2*b* are independently variable. The multiple inner cylinders 2-2*a*, 2-2*b* can not only more precisely classify than the mono-inner cylinder, but also collect a powder having a small particle diameter with an outer tube, a powder having a medium particle diameter with an inner tube, and a powder having a large particle diameter in a collection container below the inverted-cone part. In addition, each of the powders is optionally recycled and a powder having a particle diameter smaller than desired can optionally be disposed.

Figure 11:
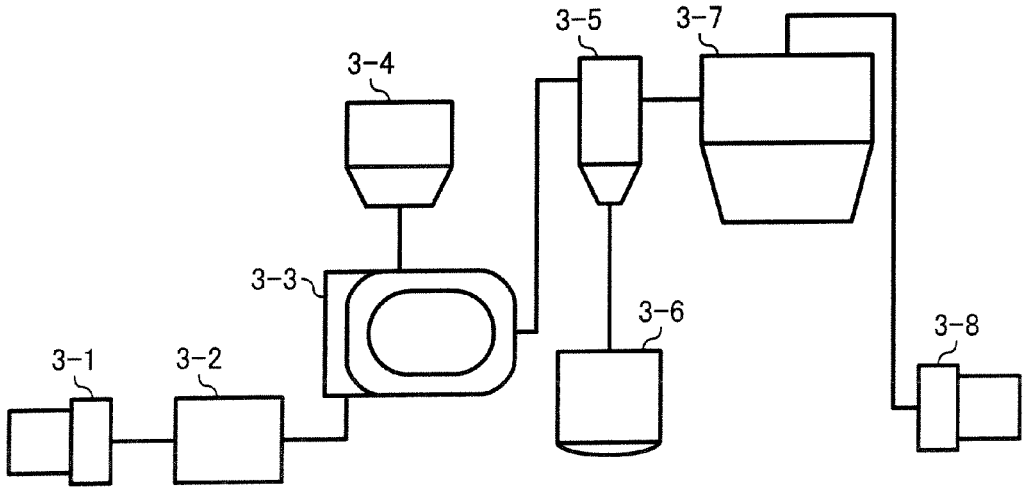
FIG. 11 is a schematic view illustrating a layout of the cyclone classifier, flash drier and incidental equipment of the present invention.
Figure 12:
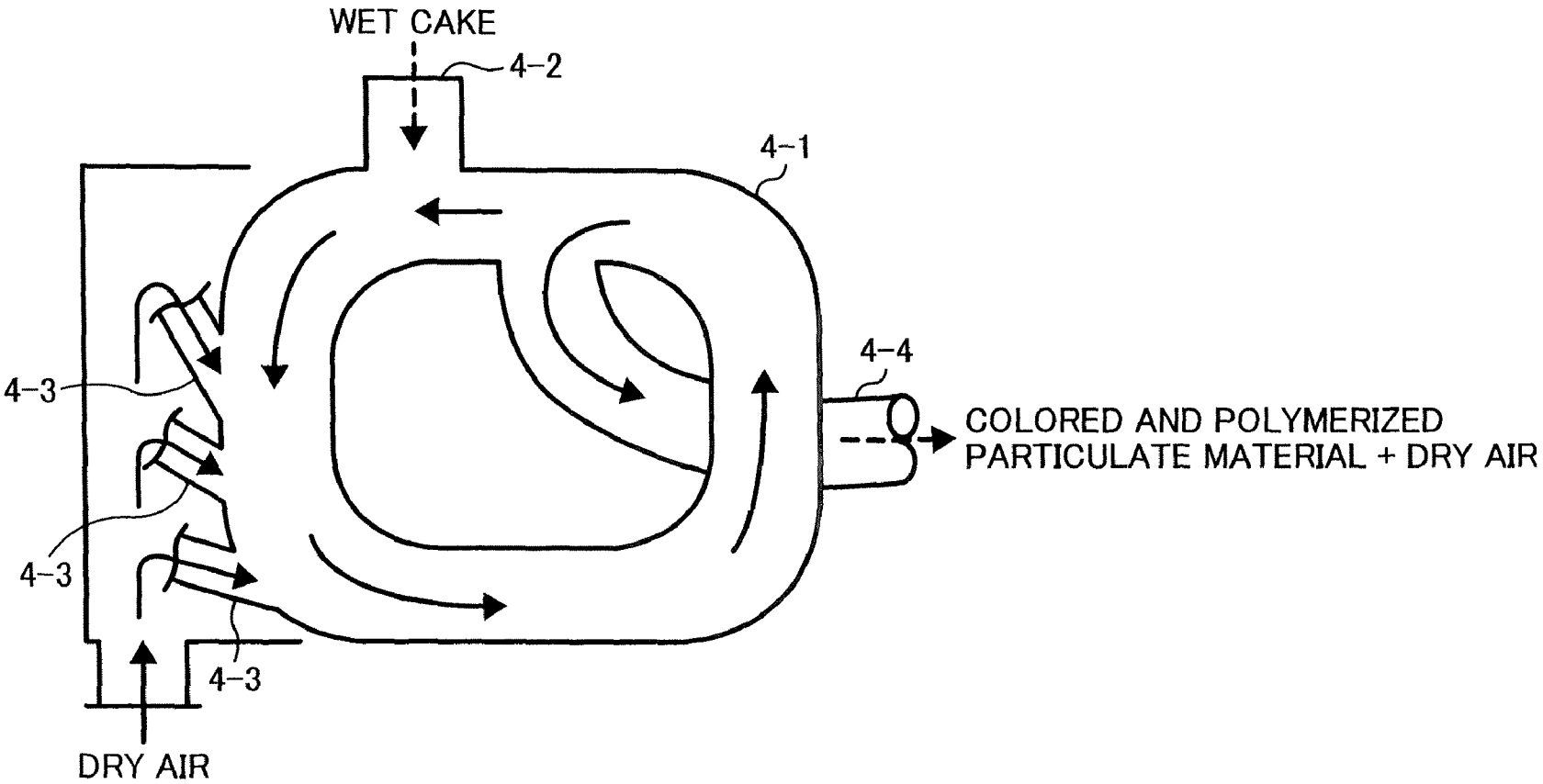
FIG. 12 is a schematic view illustrating the flash drier in FIG. 5.

In one embodiment of the present invention, a solid-gas separation cyclone installed in other equipment can be used as a classifying cyclone. Therefore, a new power source is not required reasonably. In embodiments of the present invention, a cyclone for collecting a powder after it is subjected to a flash drying is used so as to have the capability of classifying the powder. A layout sketch of the actual flash drier and the cyclone is shown in FIG. 11, and an outline of the flash drier is shown in FIG. 12. As shown in FIG. 11, an air flow supplied by an air supply fan (3-1) is heated by a heater (3-2) to be dried air, and which is fed to a flash drier (3-3). At the same time, a wet cake is fed to the flash drier (3-3) from a provider (3-4). A colored and polymerized particulate material fully pulverized and dried passes through an outlet and is trapped by a cyclone (3-5) and collected in a tank (3-6) In FIG. 11, (3-7) is a bug filter, and (3-8) is an exhaust fan. In this embodiment of the present invention, a trapping cyclone is modified to have classifying capability.

In FIG. 12, (4-1) is a flash drier, (4-2) is a wet cake inlet, (4-3) is a dry air feed opening and (4-4) is an outlet for the colored and polymerized particulate material after it is dried and the dry air. In the flash drier (4-1), a heated dry air is fed into the flash drier (4-1) from the dry air feed opening (4-3). The dry air circulates in the flash drier (4-1), wet cake is continuously fed from the wet cake inlet (4-2), and dry air is continuously discharged from the outlet (4-4) with the colored and polymerized particulate material after it is dried.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

683 parts of water, 11 parts of a sodium salt of an adduct of a sulfuric ester with ethyleneoxide methacrylate (ELEMINOL RS-30 from Sanyo Chemical Industries, Ltd.), 138 parts of styrene, 138 parts of methacrylate, and 1 part of persulfate ammonium were mixed in a reactor vessel including a stirrer and a thermometer, and the mixture was stirred at 400 rpm for 15 min to prepare a white emulsion.

The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion [a particulate dispersion] of a vinyl resin (a copolymer of a sodium salt of an adduct of styrene-methacrylate-butylacrylate-sulfuric ester with ethyleneoxide methacrylate).

Further, 990 parts of water, 83 parts of the particulate dispersion 1, 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid [an aqueous phase].

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 44 parts of trimellitic acid anhydride were added thereto and the mixture was reacted for 2 hrs at a normal pressure and 180° C. to prepare a low-molecular-weight polyester.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Next, the mixture was depressurized to 10 to 15 mm Hg and reacted for 5 hrs to prepare an intermediate polyester.

Next, 410 parts of the intermediate polyester 1, 89 parts of isophoronediisocyanate and 500 parts of ethyl acetate were reacted in a reactor vessel including a cooling pipe, a stirrer and a nitrogen inlet pipe for 5 hrs at 100° C. to prepare an oil phase A.

170 parts of isophoronediamine and 75 parts of methyl ethyl ketone were reacted at 50° C. for 5 hrs in a reaction vessel including a stirrer and a thermometer to prepare a ketimine compound.

1,200 parts of water, 540 parts of carbon black Printex 35 from Degussa AG having a dibutylphthalate oil absorption of 42 ml/100 mg when measured by JIS K6221 and a pH of 9.5 and 1,200 parts of a polyester resin were mixed by a HENSCHEL MIXER from Mitsui Mining Co., Ltd. After the mixture was kneaded by a two-roll mill having a surface temperature of 150° C. for 30 min, the mixture was extended by applying pressure, cooled and pulverized by a pulverizer to prepare a masterbatch.

378 parts of the low-molecular-weight polyester, 110 parts of carnauba wax, 22 parts of charge controlling agent (salicylic acid metal complex E-84 from Orient Chemical Industries, Ltd.) and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the masterbatch and 500 parts of ethyl acetate were added to the mixture and mixed for 1 hr to prepare a material solution.

1,324 parts of the material solution were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having a diameter of 0.5 mm for 80% by volume.

Next, 1,324 parts of an ethyl acetate solution of the low-molecular-weight polyester having a concentration of 65% were added to the material solution and the mixture was stirred by the beads mill for 1 pass under the same conditions to prepare a pigment and wax dispersion.

664 parts of the pigment and wax dispersion and 5.9 parts of the ketimine compound were dispersed in a container to prepare an oil phase B.

74 parts of the oil phase A and 60.4 parts of the oil phase B were each fed by a pump and mixed in a Static Mixer from Noritake Co., Ltd. The uniformly mixed oil phase was joined together with 101.6 parts of the aqueous phase fed by a pump, and the mixture were sheared by a continuous emulsifier pipeline homomixer from PRIMIX Corp. at 8,400 rpm to be emulsified to prepare a slurry A wherein a microscopic oil phase droplet which becomes acolored and polymerized particulate material is present in the aqueous phase medium.

The slurry A was put in a vessel including a stirrer and a thermometer. After a solvent was removed from the slurry A at 40° C. for 8 hrs, the slurry was aged at 60° C. for 8 hrs to prepare a slurry B.

100 parts of the slurry B were subjected to solid-liquid separation by a filter press and dehydrated at 0.4 MPa to prepare a wet cake A.

100 parts of the wet cake A were uniformly dispersed in 200 parts of ion-exchanged water by a TK-type homomixer at 6,000 rpm for 30 min to prepare a dispersion slurry A.

100 parts of the dispersion slurry A were solid-liquid subjected to solid-liquid separation by a siphon-pillar centrifuge at a centrifugal effect of 1,000 G to prepare a wet cake B.

The wet cake B was dried by a flash drier. The wet cake B had a moisture content of 25% by weight.

The drying conditions were as follows:

air volume: 10 $m^3$/min entrance temperature: 65° C.; and exit temperature: 33° C.

The drying speed was 0.5 kg/min. The wet cake B had a moisture content of 0.9% by weight after dried.

The colored and polymerized particulate material was classified by an experimental cyclone classifier. The cyclone classifier and the flash drying system including the cyclone classifier are shown in FIG. 1. The aspiration of the exhaust fan 18 generates swirling flows in the cyclone collector 16 and cyclone classifier 14. First, the powder feeder 11 continuously discharges a determined amount of the colored and polymerized particulate material into the saucer 13. The colored and polymerized particulate material discharged in the saucer 13 is transported into the cyclone classifier 14 by the aspiration of the exhaust fan 18 and the powder feeding air 12. The colored and polymerized particulate material classified by the swirling flow in the cyclone classifier 14, having a desired particle diameter and a particle diameter distribution, falls in a collection container 15 collecting desired particles. The colored and polymerized particulate material having a diameter smaller than desired is discharged from the inner cylinder of the cyclone classifier 14 and enters the cyclone collector 16. The swirling flow of the cyclone collector 16 collects all the colored and polymerized particulate material having a diameter smaller than desired, and they fall in a collection container 17 collecting smaller particles.

The cyclone classifier used in Example 1 is shown in FIG. 2.

Various circles therein are schematic views of the colored and polymerized particulate materials in consideration of their sizes.

The colored and polymerized particulate materials having wide particle diameter distributions, which are flown in from the inlet 21, receive centrifugal forces in the cyclone outer cylinder 22A from the swirling flow therein, and gradually descend along the cyclone outer cylinder 22A. Near the upper surface of the orifice plate 23, a hole thereof narrows the flow passage area. Therefore, the swirling speed quickly increases and the centrifugal forces applied to the colored and polymerized particulate materials quickly enlarge.

The air flow passing through the hole of the orifice plate 23 is released therefrom, and is radially dispersed by the centrifugal forces accumulated in the particles in the cyclone outer cylinder 22B. The colored and polymerized particulate material having a large particle diameter, which receives a large centrifugal force, is ejected to the wall of the enlarged portion and dispersed, and then falls along the wall of the cyclone outer cylinder 22B and is collected in a collection container (not shown) collecting desired particles. The colored and polymerized particulate material having a small particle diameter, which receives a small centrifugal force, remains in the center of the enlarge member and is discharged from the cyclone classifier with an exhaust from the cyclone inner cylinder 24.

The colored and polymerized particulate material for use in Examples and Comparative Examples had a volume-average particle diameter (Dv) of 5.8 μm and Dv/Dn (number-average particle diameter) of 1.18. The colored and polymerized particulate material includes particles having a diameter not greater than 4 μm in an amount of 14.6% by number and particles having a diameter not less than 12.7 μm in an amount of 1.3% by number.

In Example 1, the air volume of the exhaust fan was 270 $m^3$/h, the feed amount of the colored and polymerized particulate material was 8.7 kg/h, and De (the diameter of the cyclone outer cylinder 22A)/Dr (the hole diameter of the orifice plate) was 1.6. The bottom end of the cyclone inner cylinder was placed at a position of 1×((De−Dr)/2) (=185 mm) from the bottom surface of the orifice plate.

Example 2

The procedure for classification of the colored and polymerized particulate material in Example 1 was repeated to classify the colored andpolymerizedparticulate material except that the bottom end of the cyclone inner cylinder was placed at a position of 9×((De−Dr)/2) (=425 mm) from the bottom surface of the orifice plate.

Example 3

The procedure for classification of the colored and polymerized particulate material in Example 1 was repeated to classify the colored andpolymerizedparticulate material except that De/Dr was 1.3 and that the bottom end of the cyclone inner cylinder was placed at a position of 5×((De−Dr)/2) (=305 mm) from the bottom surface of the orifice plate.

Example 4

The procedure for classification of the colored and polymerized particulate material in Example 1 was repeated to classify the colored and polymerized particulate material except that De/Dr was 1.3 and that the bottom end of the cyclone inner cylinder was placed at a position of 9×((De−Dr)/2) (=425 mm) from the bottom surface of the orifice plate.

Example 5

The procedure for classification of the colored and polymerized particulate material in Example 1 was repeated to classify the colored and polymerized particulate material except for replacing the cyclone classifier with the cyclone classifier (14 in FIG. 1) described with respect to FIG. 3, including a double enlarged portion including 2 orifice plates 33A and 33B and double inner cylinder 34A and 34B mixing the colored and polymerized particulate materials and transferring them to the cyclone collector 16 in FIG. 1. In Example 5, the air volume of the exhaust fan was 270 $m^3$/h, the feed amount of the colored and polymerized particulate material was 8.7 kg/h, and De (the diameter of the cyclone outer cylinder 32A)/Dr (each of the two orifice plates has a hole having the same diameter) was 1.6. The bottom ends of the cyclone inner cylinders 34A and 34B were placed at positions of 1×((De−Dr)/2) (=185 mm) from the bottom surfaces of the orifice plates 33A and 33B respectively.

Example 6

Figure 4:
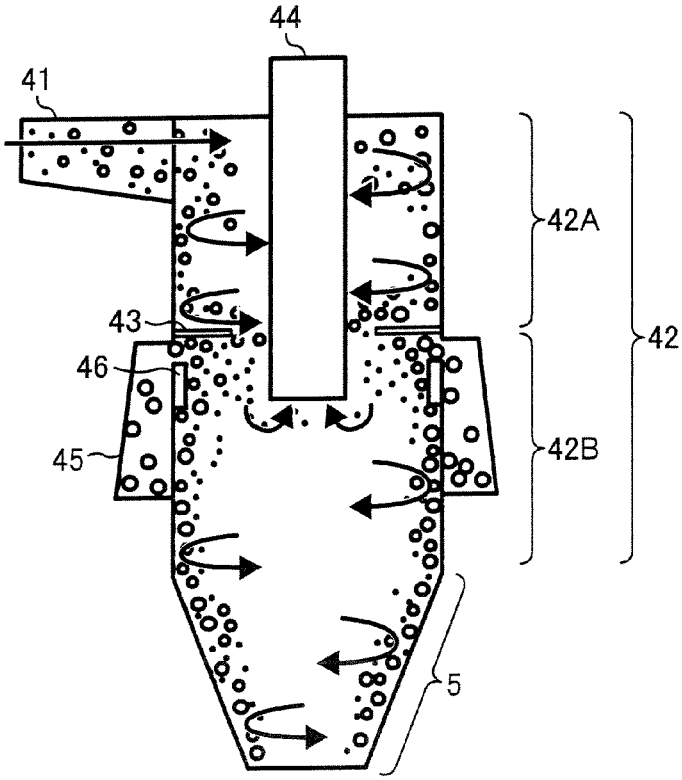
FIG. 4 is a schematic view illustrating a further embodiment of the cyclone classifier of the present invention.

The procedure for classification of the colored and polymerized particulate material in Example 1 was repeated to classify the colored and polymerized particulate material except for replacing the cyclone classifier with the cyclone classifier in FIG. 4, including a collection pocket 45 collecting particles having large particle diameters. In Example 6, a slide 46 controlling the inlet of the collection pocket 45 was not used. The air volume of the exhaust fan was 270 $m^3$/h, the feed amount of the colored and polymerized particulate material was 8.7 kg/h, and De/Dr was 1.6. The bottom end of the cyclone inner cylinder 44 was placed at positions of 1×((De−Dr)/2) (=185 mm) from the bottom surface of the orifice plate 43.

Example 7

The procedure for classification of the colored and polymerized particulate material in Example 1 was repeated to classify the colored and polymerized particulate material except for replacing the cyclone classifier with the cyclone classifier in FIG. 4, including a collection pocket 45 collecting particles having large particle diameters. In Example 7, the slide 46 reduced the inlet of the collection pocket 45 by one half. The air volume of the exhaust fan (not shown in FIG. 4) was 270 $m^3$/h, the feed amount of the colored and polymerized particulate material was 8.7 kg/h, and De/Dr was 1.6. The bottom end of the cyclone inner cylinder 44 was placed at positions of 1×((De-Dr)/2) (=185 mm) from the bottom surface of the orifice plate 43.

Example 8

Figure 5:
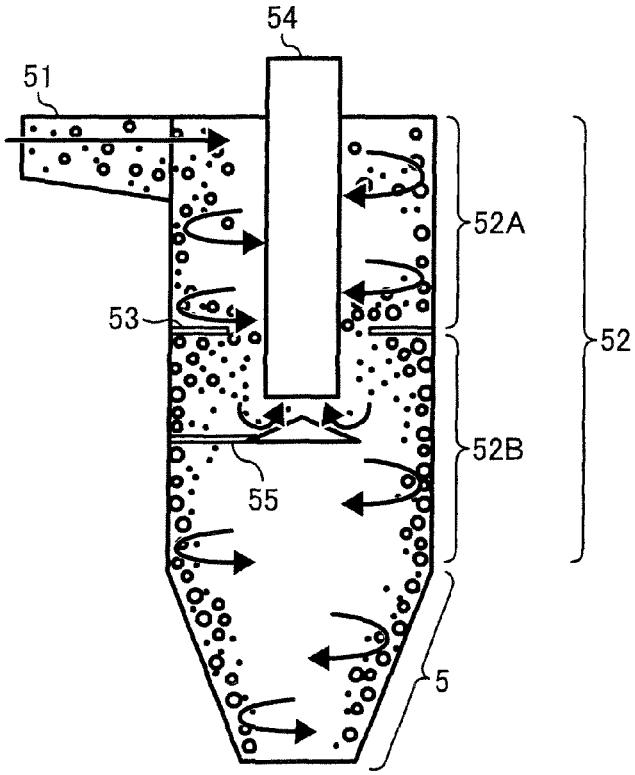
FIG. 5 is a schematic view illustrating another embodiment of the cyclone classifier of the present invention.

The procedure for classification of the colored and polymerized particulate material in Example 1 was repeated to classify the colored and polymerized particulate material except for replacing the cyclone classifier with the cyclone classifier in FIG. 5, including a cone control plate 55 toward the bottom end of the inner cylinder 54. The area of the gap therebetween was ⅔ of that of the bottom end of the inner cylinder 54. The air volume of the exhaust fan (not shown in FIG. 5) was 270 $m^3$/h, the feed amount of the colored and polymerized particulate material was 8.7 kg/h, and De/Dr was 1.6. The bottom end of the cyclone inner cylinder 54 was placed at positions of 9×((De-Dr)/2) (=425 mm) from the bottom surface of the orifice plate 53.

Example 9

The procedure for classification of the colored and polymerized particulate material in Example 1 was repeated to classify the colored and polymerized particulate material except that De/Dr was 1.1.

Example 10

The procedure for classification of the colored and polymerized particulate material in Example 1 was repeated to classify the colored and polymerized particulate material except that De/Dr was 1.1 and that the bottom end of the cyclone inner cylinder was placed at a position of 12×((De−Dr)/2) (=515 mm) from the bottom surface of the orifice plate.

Comparative Example 1

The procedure for classification of the colored and polymerized particulate material in Example 1 was repeated to classify the colored and polymerized particulate material except for using a cyclone classifier including a waistless outer cylinder without an enlarged portion and an inner cylinder. The bottom end of the cyclone inner cylinder was placed such that the inner cylinder has a length of 185 mm.

Comparative Example 2

The procedure for classification of the colored and polymerized particulate material in Example 1 was repeated to classify the colored and polymerized particulate material except for using a cyclone classifier including a waistless outer cylinder without an enlarged portion and an inner cylinder. The bottom end of the cyclone inner cylinder was placed such that the inner cylinder has a length of 305 mm.

Comparative Example 3

The procedure for classification of the colored and polymerized particulate material in Example 1 was repeated to classify the colored and polymerized particulate material except for using a cyclone classifier including a waistless outer cylinder without an enlarged portion and an inner cylinder. The bottom end of the cyclone inner cylinder was placed such that the inner cylinder has a length of 515 mm.

The particle diameters of 50,000 particles of each colored and polymerized particulate material classified in Examples 1 to 10 and Comparative Examples 1 to 3 were measured by a Coulter counter Multisizer from Beckman Coulter, Inc., selectively using an aperture having a diameter of 50 μm in compliance with the particle diameters of the colored and polymerized particulate material and a toner.

The results are shown in Table 1.

TABLE 1

| | Dv μm | Dv/Dn | Content of particles having not greater than 4 μm % by number | Content of particles having not less than 12 μm % by volume | Yield % |
|---|---|---|---|---|---|
| Example 1 | 5.9 | 1.13 | 9.0 | 1.4 | 95 |
| Example 2 | 5.9 | 1.15 | 9.8 | 1.4 | 95 |
| Example 3 | 5.8 | 1.14 | 10.9 | 1.3 | 88 |
| Example 4 | 5.8 | 1.15 | 11.0 | 1.2 | 94 |
| Example 5 | 5.9 | 1.12 | 8.1 | 1.5 | 98 |
| Example 6 | 5.7 | 1.13 | 9.2 | 1.0 | 91 |
| Example 7 | 5.8 | 1.13 | 8.6 | 1.2 | 94 |
| Example 8 | 5.9 | 1.11 | 8.2 | 1.4 | 94 |
| Example 9 | 5.9 | 1.15 | 12.9 | 1.4 | 95 |
| Example 10 | 5.8 | 1.18 | 14.6 | 1.3 | 99 |
| Comparative Example 1 | 5.8 | 1.18 | 14.5 | 1.5 | 83 |
| Comparative Example 2 | 5.9 | 1.16 | 12.2 | 1.4 | 89 |
| Comparative Example 3 | 5.8 | 1.18 | 14.5 | 1.4 | 99 |

The contents of particles having not greater than 4 μm in Examples 1 to 5 are lower than those of the Comparative Examples. Further, Examples 1 to 5 have a better yield. In Examples 6 and 7, particles having large particle diameters are classified as well. The particles are controlled by the inlet area of the pocket collecting them. Example 8, wherein the inlet speed is faster than other Examples, can precisely classify particles at a high yield.

Example 11

Figure 7:
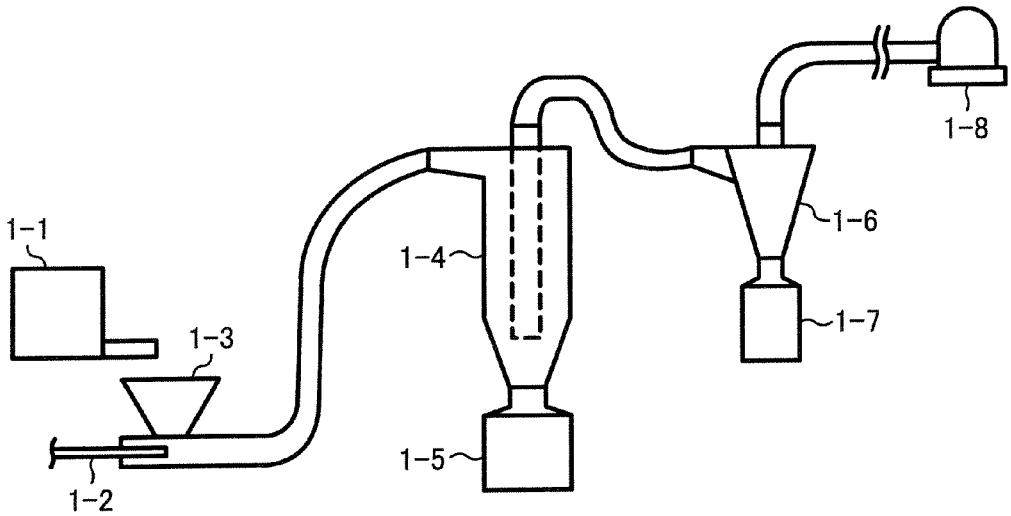
FIG. 7 is a schematic view illustrating a layout of the cyclone classifier and incidental equipment of the present invention.

The colored and polymerized particulate material was classified by an experimental cyclone classifier. The cyclone classifier and the flash drying system including the cyclone classifier are shown in FIG. 7. The aspiration of the exhaust fan (1-8) generates swirling flows in the cyclone collector (1-6) and cyclone classifier (1-4). First, the powder feeder (1-1) continuously discharges a determined amount of the colored and polymerized particulate material into the saucer (1-3). The colored and polymerized particulate material discharged in the saucer (1-3) is transported into the cyclone classifier (1-4) by the aspiration of the exhaust fan (1-8) and the powder feeding air (1-2). The colored and polymerized particulate material classified by the swirling flow in the cyclone classifier (1-4), having a desired particle diameter and a particle diameter distribution, falls in a collection container (1-5) collecting desired particles. The colored and polymerized particulate material having a diameter smaller than desired is discharged from the inner cylinder of the cyclone classifier (1-4) and enters the cyclone collector (1-6). The swirling flow of the cyclone collector (1-6) collects all the colored and polymerized particulate material having a diameter smaller than desired, and they fall in a collection container (1-7) collecting smaller particles.

The cyclone classifier used in Example 11 is shown in FIG. 8.

The colored and polymerized particulate materials having wide particle diameter distributions, which are flown in from an inlet (2-1), receive centrifugal forces in the waistless part of the cyclone outer cylinder (2-3) from the swirling flow therein, and gradually descend along an inverted-cone part of the cyclone outer cylinder (2-4). The colored and polymerized particulate materials having a small particle diameter, which receive a centrifugal force in the waistless part of the cyclone outer cylinder (2-3) and the inverted-cone part of the cyclone outer cylinder (2-4), gather in the center of the cyclone (swirl) is discharged from the cyclone classifier of the present invention with an exhaust from a cyclone inner cylinder (2-2).

The colored and polymerized particulate material for use in Examples 11 to 18 and Comparative Examples 4 and 5 had a volume-average particle diameter (Dv) of 5.8 μm. Dv/Dn (number-average particle diameter) is a particle diameter distribution width of a powder. The closer the Dv/Dn to 1.00, the smaller the width, which means the powder has a uniform particle diameter. The Dv/Dn of the colored and polymerized particulate material was 1.18. The colored and polymerized particulate material includes particles having a diameter not greater than 4 μm in an amount of 14.6% by number, which are to be excluded.

The air volume of the exhaust fan was 270 $m^3$/h, the feed amount of the colored and polymerized particulate material was 8.7 kg/h, the inner diameter of the cyclone outer cylinder (2-3) was 155 mm, the length of the cyclone outer cylinder (2-3) was 300 mm, the length of the inverted-cone part of the cyclone outer cylinder (2-4: length in the vertical direction) was 200 mm, an inclined angle (2-γ) between a bus bar (2-α) and a normal (2-β) was 15°, and the inner diameter of the inner cylinder (2-2) was 55 mm.

In Example 11, the length of the inner cylinder (2-2) in the cyclone was 350 mm from a top surface (2-5) of the cyclone outer cylinder.

Example 12

The procedure for classification of the colored and polymerized particulate material in Example 11 was repeated to classify the colored and polymerized particulate material except that the length of the inner cylinder (2-2) in the cyclone was 400 mm from a top surface (2-5) of the cyclone outer cylinder.

Example 13

The procedure for classification of the colored and polymerized particulate material in Example 11 was repeated to classify the colored and polymerized particulate material except that the length of the inner cylinder (2-2) in the cyclone was 450 mm from a top surface (2-5) of the cyclone outer cylinder.

Example 14

The procedure for classification of the colored and polymerized particulate material in Example 11 was repeated to classify the colored and polymerized particulate material except that the length of the inner cylinder (2-2) in the cyclone was 460 mm from a top surface (2-5) of the cyclone outer cylinder.

Example 15

The procedure for classification of the colored and polymerized particulate material in Example 11 was repeated to classify the colored and polymerized particulate material except that the inclined angle (2-γ) between a bus bar (2-α) and a normal (2-β) was 450, and the length of the inner cylinder (2-2) in the cyclone was 310 mm from a top surface (2-5) of the cyclone outer cylinder.

Example 16

The procedure for classification of the colored and polymerized particulate material in Example 11 was repeated to classify the colored and polymerized particulate material except that the inclined angle (2-γ) between a bus bar (2-α) and a normal (2-β) was 450, and that the length of the inner cylinder (2-2) in the cyclone was 320 mm from a top surface (2-5) of the cyclone outer cylinder.

Example 17

Figure 9:
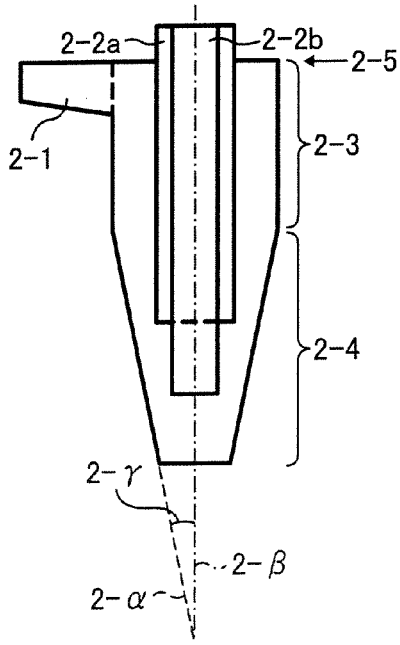
FIG. 9 is a schematic view illustrating another embodiment of the cyclone classifier (double inner cylinder) of the present invention.
Figure 10:
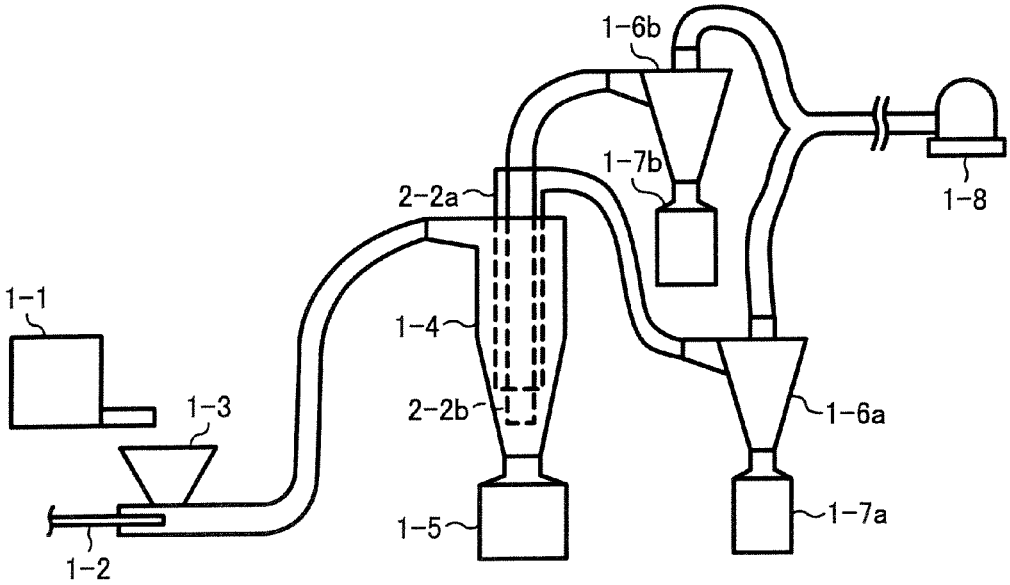
FIG. 10 is a schematic view illustrating a layout of the cyclone classifier (double inner cylinder) and incidental equipment of the present invention.

The double inner cylinder was used (FIG. 9). Next, as shown in FIG. 10, small-sized particles discharged from an outer tube with an exhaust are collected in a small-sized particle container (1-7*a*) by a cyclone collector (1-6*a*). Medium-sized particles discharged from an inner tube with an exhaust are collected in a medium-sized particle container (1-7*b*) by a cyclone collector (1-6*b*).

In Example 17, as shown in FIG. 9, the procedure for classification of the colored and polymerized particulate material in Example 11 was repeated to classify the colored and polymerized particulate material except that the length of an outer tube of the inner cylinder (2-2*a*) in the cyclone was 420 mm from a top surface (2-5) of the cyclone outer cylinder (2-3) and that the length of an inner tube of the inner cylinder (2-2*b*) in the cyclone was 460 mm from a top surface (2-5) of the cyclone outer cylinder (2-3). The outer tube of the inner cylinder (2-2*a*) had an inner diameter of 70 mm, the inner tube of the inner cylinder (2-2*b*) had an inner diameter of 55 mm, and further, inner cylinders in the cyclone collector (1-6*a*) and the cyclone collector (1-6*b*) have an inner diameter of 55 mm and a length of 130 mm.

Example 18

The double inner cylinder was used as used in Example 17. As shown in FIG. 10, small-sized particles discharged from an outer tube with an exhaust are collected in a small-sized particle container (1-7*a*) by a cyclone collector (1-6*a*). Medium-sized particles discharged from an inner tube with an exhaust are collected in a medium-sized particle container (1-7*b*) by a cyclone collector (1-6*b*).

In Example 18, the procedure for classification of the colored and polymerized particulate material in Example 11 was repeated to classify the colored and polymerized particulate material except that the length of an outer tube of the inner cylinder (2-2*a*) in the cyclone was 440 mm from a top surface (2-5) of the cyclone outer cylinder, and that the length of an inner tube of the inner cylinder (2-2*b*) in the cyclone was 460 mm from a top surface (2-5) of the cyclone outer cylinder.

Comparative Example 4

The procedure for classification of the colored and polymerized particulate material in Example 11 was repeated to classify the colored and polymerized particulate material except that the length of the inner cylinder (2-2) in the cyclone was 150 mm from a top surface (2-5) of the cyclone outer cylinder. The aspirating opening at the end of the cyclone inner cylinder (2-2) is located within the height of the waistless part of the cyclone outer cylinder (2-3).

Comparative Example 5

The procedure for classification of the colored and polymerized particulate material in Example 11 was repeated to classify the colored and polymerized particulate material except that the length of the inner cylinder (2-2) in the cyclone was 250 mm from a top surface (2-5) of the cyclone outer cylinder. The aspirating opening at the end of the cyclone inner cylinder (2-2) is located within the height of the waistless part of the cyclone outer cylinder (2-3).

The particle diameters of 50,000 particles of each colored and polymerized particulate material classified in Examples 11 to 18 and Comparative Examples 4 and 5 were measured by a Coulter counter Multisizer from Beckman Coulter, Inc., selectively using an aperture having a diameter of 50 μm in compliance with the particle diameters of the colored and polymerized particulate material and a toner. The yield in Table 2 is a value determined by dividing the weight of the colored and polymerized particulate material collected in the collection container (1-5) after it is classified with the total weight thereof before it is classified. In other words, it can be said that the yield is a weight ratio of a powder collected in the collection container (1-5) to a total weight thereof before it is classified.

The results are shown in Table 2.

TABLE 2

| | Dv (μm) | Dv/Dn | Content of particles having not greater than 4 μm (% by number) | Yield (%) |
|---|---|---|---|---|
| Example 11 | 5.9 | 1.14 | 12.5 | 98 |
| Example 12 | 5.9 | 1.14 | 11.2 | 95 |
| Example 13 | 5.9 | 1.13 | 10.3 | 91 |
| Example 14 | 5.9 | 1.13 | 9.4 | 90 |
| Example 15 | 5.9 | 1.13 | 10.5 | 89 |
| Example 16 | 5.9 | 1.15 | 12.1 | 72 |
| Example 17 | 5.9 | 1.13 | 9.1 | 94 |
| Example 18 | 5.9 | 1.13 | 8.5 | 93 |
| Comparative Example 4 | 5.8 | 1.18 | 14.6 | 100 |
| Comparative Example 5 | 5.8 | 1.18 | 14.1 | 99 |

As shown in Table 2, in Comparative Examples 4 and 5, even though the aspirating opening at the end of the inner cylinder is present in the waistless outer cylinder, the classification effect is very small. In Examples 11 to 14, as the end of the inner cylinder is lowered, the content of a microscopic powder having a diameter not greater than 4 μm decreased, and the Dv/Dn representing a particle diameter distribution width also improves.

In Example 16, wherein the inclined angle between a bus bar and a normal of the inverted-cone part of the cyclone outer cylinder (2-4) was 450, the end of the inner cylinder was placed about 30 mm from the inner surface of the inverted-cone part of the cyclone outer cylinder. In Example 15, the end of the inner cylinder was placed another 10 mm therefrom. In Example 14, wherein the inclined angle between a bus bar and a normal of the inverted-cone part of the cyclone outer cylinder was 15°, the end of the inner cylinder was placed about 30 mm from the inner surface of the inverted-cone part of the cyclone outer cylinder. In Example 13, the end of the inner cylinder was placed another 10 mm therefrom. In Example 16, aspirating particles having a desired particle diameter as well as particles having a small particle diameter. Therefore, the classification preciseness in Example 16 is worse than that of Example 15. The precise control by the movement of 10 mm in Examples 15 and 16 is worse than that in Examples 13 and 14. Therefore, an inclined angle that is not less than 45° between a bus bar and a normal of the inverted-cone part of the cyclone outer cylinder is not preferable for precise classification.

Example 17, using a double inner cylinder which aspirates particles having a small particle diameter twice, can more precisely exclude only particles having a small particle diameter. Further, Example 18, using a telescopic double inner cylinder wherein the length of the outer tube of the inner cylinder (2-2*a*) in the cyclone was changed, can control the classifying particle diameters as desired.

This application claims priority and contains subject matter related to Japanese Patent Applications Nos. 2005-334254, 2006-070287, 2006-209635 and 2006-226266, filed on Nov. 18, 2005, Mar. 15, 2006, Aug. 1, 2006 and Aug. 23, 2006, respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A cyclone classifier for classifying a particulate material, comprising:

an outer cylinder, including, a waistless part including a non-enlarged portion having an inner diameter, an enlarged portion positioned below the non-enlarged portion and having an inner diameter that is larger than the inner diameter of the non-enlarged portion, and a contracted part positioned between the non-enlarged portion and the enlarged portion and formed of a cylinder having a contracted inner diameter or an orifice-formed baffle plate extending further inward than the inner diameter of the non-enlarged portion, and an inverted-cone part vertically connected to an underside of the waistless part;

an inlet attached to the non-enlarged portion; and an inner cylinder including an exhaust opening, wherein the inner cylinder has a bottom end present under the contracted part in the waistless part.

2. The cyclone classifier of claim 1, wherein the following relationship is satisfied:

$$De>1.2\times Dr$$

wherein De represents a diameter of the inverted-cone part; and Dr represents a diameter when the contracted part includes a cylinder having a contracted inner diameter or a pore diameter when the contracted part includes an orifice-formed baffle plate.

3. The cyclone classifier for classifying a particulate material, comprising:

an outer cylinder, including, a waistless part including a non-enlarged portion having an inner diameter, an enlarged portion positioned below the non-enlarged portion and having an inner diameter that is larger than the inner diameter of the non-enlarged portion, and a contracted part positioned between the non-enlarged portion and the enlarged portion and formed of a cylinder having a contracted inner diameter or an orifice-formed baffle plate extending further inward than the inner diameter of the non-enlarged portion, and an inverted-cone part vertically connected to an underside of the waistless part;

an inlet attached to the non-enlarged portion; and an inner cylinder including an exhaust opening, wherein the inner cylinder has a bottom end and the bottom end of the inner cylinder is present within a height of the inverted-cone part.

4. The cyclone classifier of claim 1, wherein the outer cylinder includes a plurality of the inverted-cone parts and the contracted parts.

5. The cyclone classifier of claim 4, further comprising:

multiple inner cylinders, wherein in each of the plural inverted-cone parts there is at least a bottom end of one of the inner cylinders.

6. The cyclone classifier of claim 1, further comprising:

a pocket configured to classify a particulate material having a large particle diameter on the outer circumference of the waistless part of the outer cylinder.

7. The cyclone classifier of claim 6, wherein the pocket further comprises a plate configured to slide up and down at an entrance of the pocket.

8. The cyclone classifier of claim 5, further comprising:

a plate or a cone controlling an area of the exhaust opening of the inner cylinder below at least one of the bottom ends of the inner cylinder.

9. The cyclone classifier of claim 8, wherein the plate or the cone is configured to slide up and down.

10. The cyclone classifier of claim 3, wherein the bottom end of the inner cylinder is vertically located below the underside of the waistless part within the following distance:

$$10\times((De-Dr)/2).$$

wherein De represents a diameter of the inverted-cone part; and Dr represents a diameter when the contracted part includes a cylinder having a contracted inner diameter or a pore diameter when the contracted part includes the orifice-formed baffle plate.

11. The cyclone classifier of claim 1, wherein the inverted-cone part has a bus bar having an inclined angle not greater than 45° to a normal of a base of the inverted-cone part.

12. The cyclone classifier of claim 1, further comprising:

multiple inner cylinders, wherein each of the multiple inner cylinders has a bottom end at a different location.

13. The cyclone classifier of claim 3, further comprising:

multiple inner cylinders, wherein each of the multiple inner cylinders has a bottom end at a different location, wherein at least one of the bottom ends of the multiple inner cylinders is present within the height of the inverted-cone part.

14. The cyclone classifier of claim 12, wherein the bottom ends of the multiple inner cylinders are independently movable.

15. The cyclone classifier of claim 12, wherein powder toners aspirated by the multiple inner cylinders are independently collected in independent collection containers.

16. The cyclone classifier of claim 1, further comprising:

a flash drier disposed to the outer cylinder.

17. A method of preparing a toner, comprising:

inserting the toner through an inlet of a waistless part, the waistless part including a non-enlarged cylindrical portion having a constant inner diameter and the inlet is attached to the non-enlarged cylindrical portion, an enlarged cylindrical portion positioned below the non-enlarged portion and having a constant inner diameter that is larger than the inner diameter of the non-enlarged cylindrical portion, and a contracted part positioned between the non-enlarged cylindrical portion and the enlarged cylindrical portion and formed of a cylinder having a contracted inner diameter or an orifice-formed baffle plate extending further inward than the constant inner diameter of the non-enlarged cylindrical portion;

passing the toner to a portion of the waistless part positioned below contracted part;

discharging particles of the toner having a diameter below a predetermined size through an exhausted opening of an inner cylinder positioned within the waistless part, and the exhaust opening is positioned under the contracted part in the waistless part; and collecting particles of the toner having a diameter equal to or above a predetermined size in a collection container positioned below the waistless part.

18. A cyclone classifier for classifying a particulate material, comprising:

an outer cylinder, including, a waistless part including a non-enlarged portion having an inner diameter, an enlarged portion positioned below the non-enlarged portion and having an inner diameter that is larger than the inner diameter of the non-enlarged potion, and a contracted part positioned between the non-enlarged portion and the enlarged portion and formed of a cylinder having a contracted inner diameter or an orifice-formed baffle plate extending further inward than the inner diameter of the non-enlarged portion, and an inverted-cone part vertically connected to an underside of the waistless part;

an inlet attached to the non-enlarged portion; and means for exhausting the classified particulate material, wherein the means for exhausting includes a bottom end present under the contracted part in the waistless part.

19. The cyclone classifier of claim 1, wherein the bottom end is a position-adjustable bottom end.

* * * * *